US010765896B2

(12) United States Patent
Aldakkan et al.

(10) Patent No.: US 10,765,896 B2
(45) Date of Patent: Sep. 8, 2020

(54) WELLS RESCUE DEVICE

(71) Applicant: King Abdul Aziz City for Science and Technology (KACST), Riyadh (SA)

(72) Inventors: Khalid Abdulrahman Aldakkan, Riyadh (SA); Omar Mohammed Alhusseini, Riyadh (SA)

(73) Assignee: KING ABDUL AZIZ CITY FOR SCIENCE AND TECHNOLOGY (KACST), Riyadh (SA)

( * ) Notice: Subject to any disclaimer, the term of this patent is extended or adjusted under 35 U.S.C. 154(b) by 18 days.

(21) Appl. No.: 14/260,268

(22) Filed: Apr. 23, 2014

(65) Prior Publication Data

US 2015/0306433 A1 Oct. 29, 2015

(51) Int. Cl.

| | |
|---|---|
| ***A62B 99/00*** | (2009.01) |
| ***B66D 3/00*** | (2006.01) |
| ***E04G 3/32*** | (2006.01) |

(52) U.S. Cl.

CPC ..... *A62B 99/00* (2013.01); *B66D 3/00* (2013.01); *E04G 3/32* (2013.01)

(58) Field of Classification Search

CPC ..... B63C 9/26; A47L 3/00; A47L 3/02; B60P 3/14; A62B 1/02; A62B 1/04; A62B 35/0012; A62B 99/00; E21F 11/00; B66D 3/00; B64D 1/22; B63B 27/16

See application file for complete search history.

(56) References Cited

U.S. PATENT DOCUMENTS

| | | | | |
|---|---|---|---|---|
| 3,603,550 | A * | 9/1971 | Byrd | 248/313 |
| 4,195,694 | A * | 4/1980 | Gizzarelli, Sr. | 169/70 |
| 4,824,076 | A * | 4/1989 | Ward | 254/384 |
| 5,022,489 | A * | 6/1991 | Sauber | B66C 5/025 182/145 |
| 5,209,538 | A * | 5/1993 | Gabruel | B66C 1/28 294/118 |
| 5,713,538 | A * | 2/1998 | Gabriel | B64D 1/22 244/118.1 |
| 5,713,710 | A * | 2/1998 | Strong et al. | 414/139.5 |
| 5,826,825 | A * | 10/1998 | Gabriel | B64D 1/22 244/137.1 |
| 5,868,357 | A * | 2/1999 | Gabriel | B64D 1/22 244/137.1 |
| 6,179,357 | B1 * | 1/2001 | Gabriel | B64D 1/22 294/118 |
| 6,505,709 | B1 * | 1/2003 | Masse | 182/145 |

(Continued)

FOREIGN PATENT DOCUMENTS

CN 203090306 * 7/2013

*Primary Examiner* — Daniel P Cahn

(74) *Attorney, Agent, or Firm* — Steven M. Shape; Dennemeyer & Associates, LLC

(57) ABSTRACT

The invention provides a well rescue device. The well rescue device includes a support assembly, a seating assembly and a gripper assembly. The support assembly includes two holding arms configured to hold the victim. The seating assembly includes an extendable seat rod and a seat attached at an end of the extendable seat rod. The seat is configured to move relative to the extendable seat rod in order to facilitate positioning of the seat relative to the victim. The gripper assembly includes a gripper that is configured to facilitate positioning of the victim relative to one or more of the support assembly and the seating assembly.

4 Claims, 3 Drawing Sheets

(56) References Cited

U.S. PATENT DOCUMENTS

| | | | | |
|---|---|---|---|---|
| 2001/0030082 | A1* | 10/2001 | Overby et al. | 182/142 |
| 2002/0046674 | A1* | 4/2002 | Kernan | 104/25 |
| 2005/0132495 | A1* | 6/2005 | Girard et al. | 5/625 |
| 2005/0250396 | A1* | 11/2005 | Hayles | 441/83 |
| 2006/0102422 | A1* | 5/2006 | Loayza | 182/36 |
| 2006/0217014 | A1* | 9/2006 | Pierce et al. | 441/123 |
| 2008/0053750 | A1* | 3/2008 | Tseng et al. | 182/82 |
| 2011/0227354 | A1* | 9/2011 | Singh | A62B 99/00 294/81.2 |
| 2012/0291203 | A1* | 11/2012 | Beurguet et al. | 5/706 |
| 2015/0166311 | A1* | 6/2015 | Flatterich | 5/706 |
| 2015/0306434 | A1* | 10/2015 | Alhusseini | A62B 99/00 297/217.1 |

* cited by examiner

WELLS RESCUE DEVICE

FIELD OF THE INVENTION

The invention generally relates to a well rescue device for rescuing a victim from a well with a narrow diameter such as, but not limited to, a water well and a bore well.

BACKGROUND OF THE INVENTION

Often victims fall in uncovered or abandoned water wells and rescuing the victims poses great challenge. Typically such water wells are around 30 to 60 cm in diameter and hundreds of meters in depth. When a victim falls in such water wells, there is little room to allow rescue personnel to go inside the water well to rescue the victim.

In such cases, rescue devices are typically used for rescuing the victim. However, such rescue devices are not able to provide ample support to the victim while lifting the victim from the well. Without adequate support, the victim may be injured while being rescued.

Thus, there is a need for an improved well rescue device.

BRIEF DESCRIPTION OF THE FIGURES

The accompanying figures together with the detailed description below forms part of the specification and serves to further illustrate various embodiments and to explain various principles and advantages all in accordance with the invention.

DETAILED DESCRIPTION OF THE INVENTION

Figure 1:
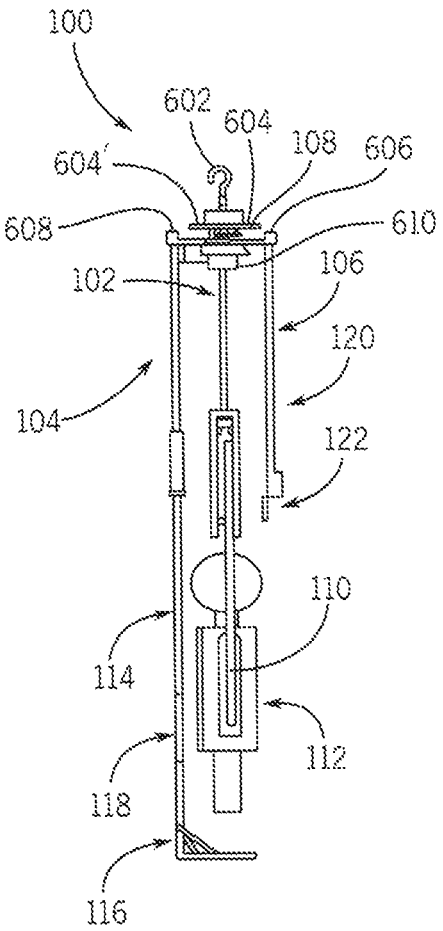
FIG. 1 and FIG. 2 illustrate a simplified side diagram and a simplified front diagram respectively of a well rescue device in accordance with an embodiment of the invention.

Before describing in detail embodiments that are in accordance with the invention, it should be observed that the embodiments reside primarily a well rescue device. Accordingly, components of the well rescue device have been represented where appropriate by conventional symbols in the drawings, showing only those specific details that are pertinent to understanding the embodiments of the invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article or composition that comprises a list of elements does not include only those elements but may include other elements not expressly listed or inherent to such process, method, article or composition. An element proceeded by "comprises . . . a" does not, without more constraints, preclude the existence of additional identical elements in the process, method, article or composition that comprises the element.

Generally speaking, pursuant to various embodiments, the invention provides a well rescue device. The well rescue device includes a support assembly, a seating assembly and a gripper assembly. In accordance with various embodiments, the support assembly includes two holding arms that are configured to hold the victim. The two holding arms are configured to hold one or more of a shoulder portion and a chest portion of the victim from two sides. In accordance with various embodiments, the seating assembly includes an extendable seat rod and a seat attached at an end of the seat rod. The seat is configured to move relative to the extendable seat rod in order to facilitate positioning of the seat relative to the victim. In accordance with various embodiments, the gripper assembly includes a gripper that is configured to facilitate positioning of the victim relative to one or more of the support assembly and the seating assembly.

Figure 2:
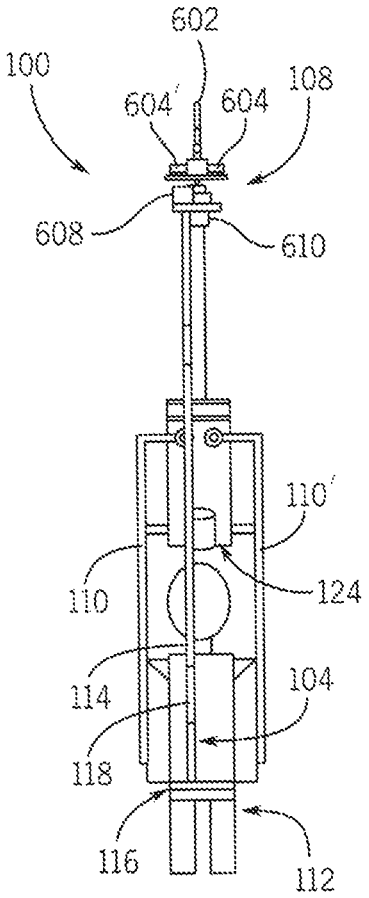

FIG. 1 and FIG. 2 illustrate a simplified side diagram and a simplified front diagram respectively of a well rescue device 100 in accordance with an embodiment of the invention. As shown in FIGS. 1 and 2, well rescue device 100 includes a support assembly 102, a seating assembly 104, a gripper assembly 106 and an adjustment assembly 108.

Support assembly 102 includes two holding arms 110, 110' configured to hold a victim 112. Two holding arms 110, 110' are configured to hold one or more of a shoulder portion and a chest portion of victim 112 from two sides as illustrated in FIGS. 1 and 2. Each of two holding arms 110, 110' includes an inflatable air bag. The gap between two holding arms 110, 110' is adjustable in order to facilitate positioning of two holding arms 110, 110' relative to one or more of the shoulder portion and the chest portion of victim 112. Support assembly 102 is described in detail in conjunction with description of FIG. 3, FIG. 4A, and FIG. 4B.

Seating assembly 104 includes an extendable seat rod 114 and a seat 116. The length of extendable seat rod 114 can be adjusted to appropriately position seat 116 underneath victim 112. The length of extendable seat rod 114 can be adjusted by utilizing adjustment assembly 108. In one implementation, the length of extendable seat rod 114 is 1990 millimeter (mm) when completely extended and 1025 mm when completely shortened. Seat 116 is attached with extendable seat rod 114 at an end of extendable seat rod 114. Further, seat 116 is configured to move relative to extendable seat rod 114 in order to facilitate positioning of seat 116 relative to victim 112. For example, seat 116 can open or close depending on the position of victim 112. In one embodiment, seat 116 is a flexible basket. The flexible basket can be a basket with three legs and a net in between the three legs. Further, the flexible basket can be designed to integrate with extendable seat rod 114 when closed and convert to an open basket configuration when open. The flexible basket can be unfolded to the open position for securing victim 112. The flexible basket can be folded and unfolded by utilizing a linear actuator 118.

Gripper assembly 106 includes a gripper arm 120 and a gripper 122 configured to facilitate positioning of victim 112 relative to one or more of support assembly 102 and seating assembly 104. Gripper 122 can be a two finger gripper. Gripper 122 can manipulate position of victim 112 to create appropriate space such that seat 116 can be positioned underneath victim 112. Alternatively, gripper 122 manipulates position of victim 112 so that two holding arms 110, 110' can be appropriately positioned relative to one or more of the shoulder portion and the chest portion of victim 112. Gripper assembly 106 is described in detail in conjunction with description of FIG. 5.

Adjustment assembly 108 is configured to move one or more of support assembly 102, seating assembly 104 and gripper assembly 106. In one implementation, adjustment assembly 108 is positioned at a top end of well rescue device 100. Adjustment assembly 108 includes adjustment devices such as, but not limited to, electric motors and actuators. The actuators of adjustment assembly 108 can be configured to control rotation of well rescue device 100 inside the well.

Optionally, well rescue device 100 includes a camera 124 as illustrated in FIG. 2. In one implementation, camera 124 is a wide angle camera which provides a video feed of victim 112 inside the well.

Figures 3, 4A, 4B, 5:
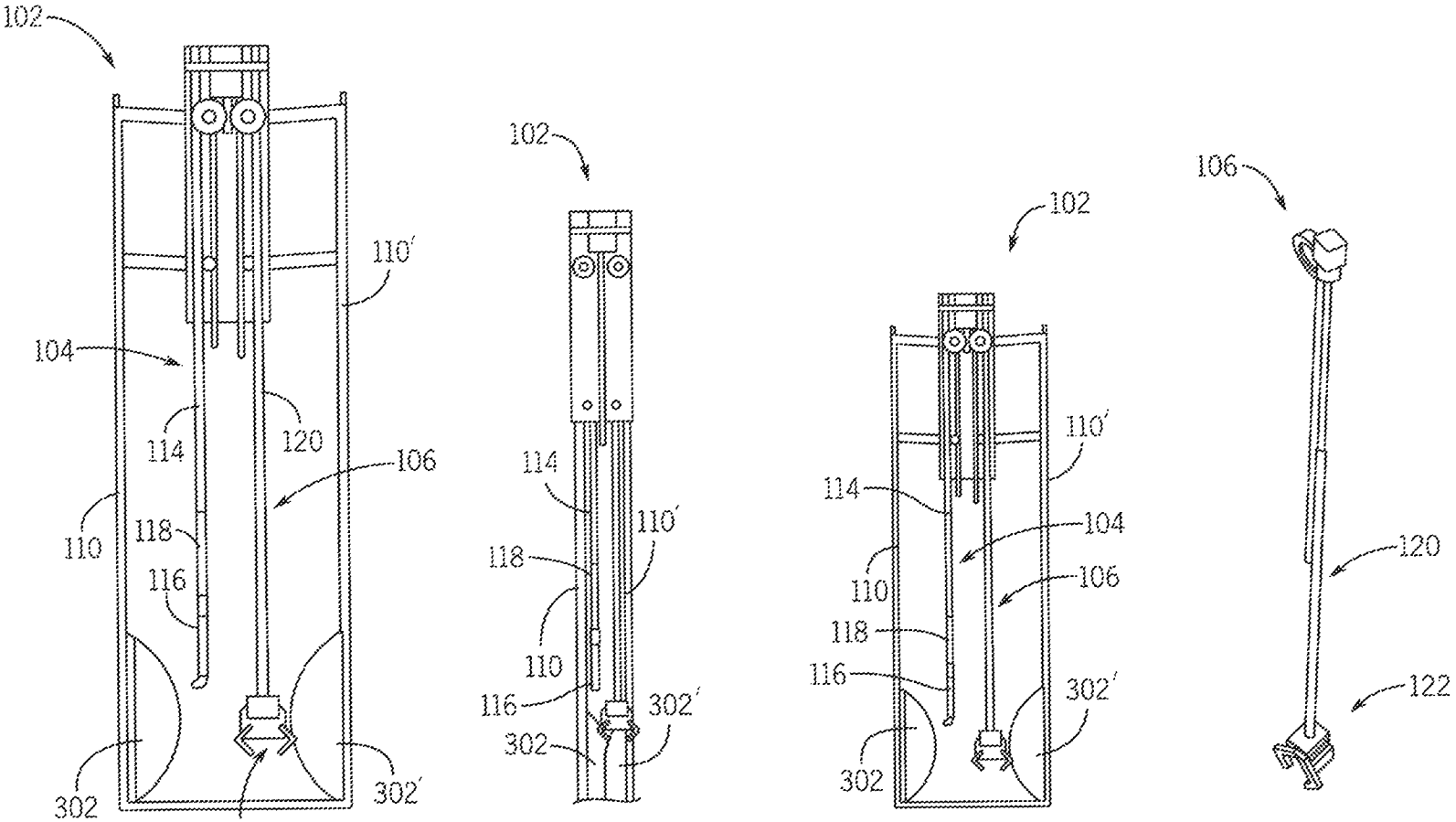
FIG. 3, FIG. 4A, and FIG. 4B illustrate a support assembly of a well rescue device in accordance with the embodiment of the invention.
FIG. 5 illustrates a gripper assembly of a well rescue device in accordance with the embodiment of the invention.

FIG. 3, FIG. 4A, and FIG. 4B illustrate support assembly 102 of well rescue device 100. Support assembly 102 includes two holding arms 110, 110' configured to hold victim 112. Each of two holding arms 110, 110' includes an inflatable air bag such as air bags 302, 302' for firmly holding victim 112. Inflatable air bags 302, 302' can be inflated using an air compressor (not illustrated in figures). The air compressor can be a part of well rescue device 100 or an external air compressor. Both inflatable air bags 302, 302' are shown in an inflated state in the FIGS. 3 and 4. The gap between two holding arms 110, 110' is adjustable in order to facilitate positioning of two holding arms 110, 110' relative to one or more of the shoulder portion and the chest portion of victim 112. The gap between two holding arms 110, 110' can be adjusted by utilizing adjustment assembly 108. For example, the electric motor can be mounted at the top of support assembly 102 to facilitate adjustment of the gap between two holding arms 110, 110'. In one implementation, the distance between two holding arms 110, 110' is 97 mm when two holding arms 110, 110' are completely contracted and 365 mm when two holding arms 110, 110' are completely extended.

FIG. 5 illustrates gripper assembly 106 of well rescue device 100. As illustrated, the length and position of gripper arm 120 can be adjusted such that gripper 122 can be used to appropriately position victim 112.

Figure 6:
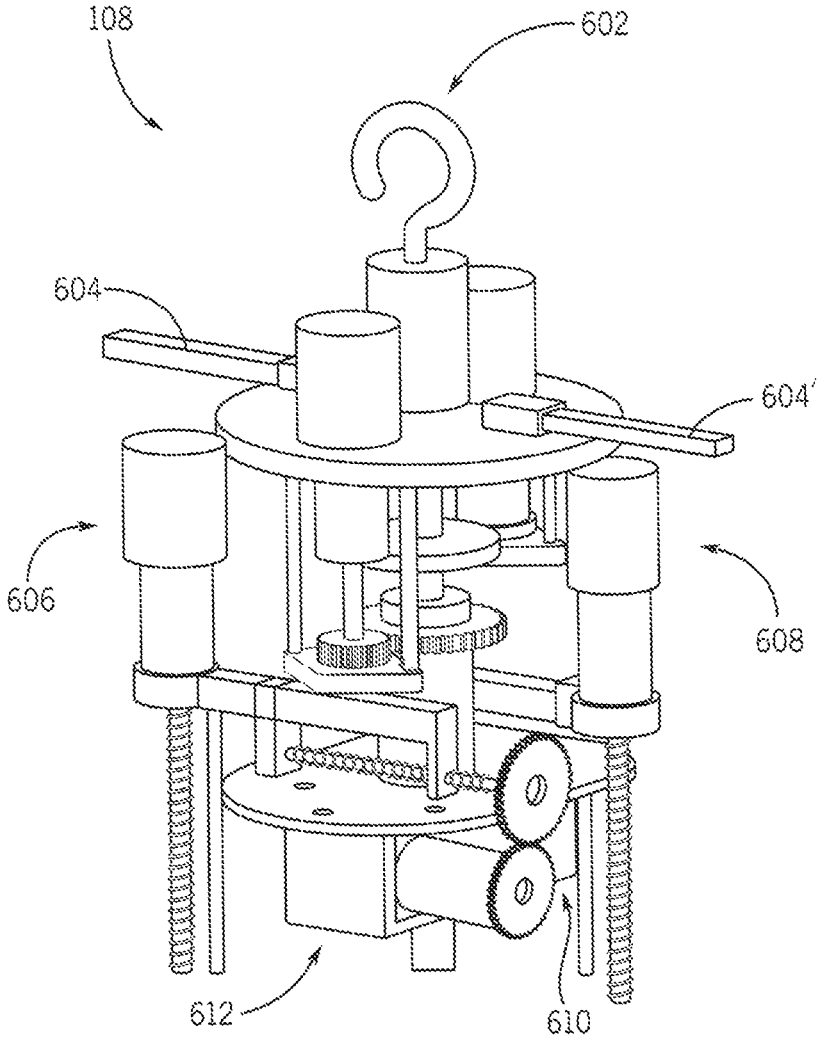
FIG. 6 illustrates an adjustment assembly of a well rescue device in accordance with the embodiment of the invention.

FIG. 6 illustrates adjustment assembly 108 of well rescue device 100. Adjustment assembly 108 includes a pin or a hook structure 602 illustrated in FIG. 6, two linear actuators 604, 604' and electric motors 606, 608, 610 and 612. Hook structure 602 can be a steel hook in order to facilitate connecting a rope for moving well rescue device 100. Linear actuators 604, 604' can be used to control rotation of well rescue device 100 inside the well. In one implementation, the distance between linear actuators 604, 604' is 650 mm when linear actuators 604, 604' are fully extended. In one implementation, electric motor 606 and electric motor 612 is connected with gripper assembly 106 (illustrated in FIG. 5), wherein electric motor 606 is used to adjust the length of gripper arm 120 (illustrated in FIG. 5) and electric motor 612 is used to move gripper assembly 106 (illustrated in FIG. 5) horizontally. Further, electric motor 608 is connected with seating assembly 104 (illustrated in FIG. 1) to adjust the length of extendable seating rod 114 (illustrated in FIG. 1). In addition, electric motor 610 is connected with seating assembly 104 (illustrated in FIG. 1) to move seating assembly 104 (illustrated in FIG. 1) horizontally.

Consider a scenario where a victim is trapped in a portion of a well. In accordance with the scenario, firstly the well rescue device is lowered to the portion of the well where the victim is trapped. Thereafter, based on the orientation of the victim, one or more of the gripper, the support assembly and the seating assembly are controlled. In this, the gripper can be used to adjust the orientation of the victim. Alternately, the gripper can be used to provide support while adjusting one or more of the support assembly and the seating assembly by holding the victim in a steady position. In case, the victim is at the bottom of the well, the gripper can be used to lift the victim for appropriately positioning the seat. The support assembly and the seating assembly can be controlled either simultaneously or one after the other for appropriately positioning the support assembly and the seating assembly relative to the victim. In this, the holding arms of the support assembly are appropriately oriented and the space between the holding arms is adjusted in order to firmly hold the victim. Further, the extendable seat rod's length is optionally adjusted as per the victim's orientation and/or dimension in order appropriately position the seat underneath the victim. Thereafter, the seat is opened to provide the seating support to the victim. Once the victim is secured to the well rescue device, the well rescue device is pulled out to bring the victim out of the well.

Various embodiments of the invention provide a well rescue device for rescuing a victim from a well. The two holding arms of well rescue device firmly hold the victim while lifting the victim from the well. Further, the seating assembly of the well rescue device prevents the victim from falling further into the well while lifting the victim from the well. In addition, the gripper is used to adjust the victim in order to better position the victim for rescue, thereby reducing/minimizing chances of the victim getting injured during the rescue.

Those skilled in the art will realize that the above recognized advantages and other advantages described herein are merely exemplary and are not meant to be a complete rendering of all of the advantages of the various embodiments of the invention.

In the foregoing specification, specific embodiments of the invention have been described. However, one of ordinary skill in the art appreciates that various modifications and changes can be made without departing from the scope of the invention as set forth in the claims below. Accordingly, the specification is to be regarded in an illustrative rather than a restrictive sense, and all such modifications are intended to be included within the scope of the invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. A well rescue device comprising:

an adjustment assembly;

a support assembly attached to the adjustment assembly;

two holding arms movably attached to the support assembly, the two holding arms configured to hold at least a shoulder of a victim, the adjustment assembly configured to move the two holding arms in a horizontal direction between a contracted position and an extended position to position the two holding arms relative to the victim;

an inflatable air bag on each of the two holding arms for securing the victim between the two holding arms;

a seating assembly attached to the adjustment assembly, the adjustment assembly configured to move the seat assembly in the horizontal direction and in a vertical direction perpendicular to the horizontal direction;

and a gripper assembly attached to the adjustment assembly, the gripper assembly including a gripper arm extendable in the vertical direction and a gripper attached to the gripper arm, wherein the adjustment assembly is configured to move the gripper arm in the horizontal direction and in the vertical direction to adjust a position of the gripper with respect to the victim.

2. The well rescue device of claim 1, wherein the gripper assembly comprises a two-finger gripper.

3. The well rescue device of claim 1, wherein the adjustment assembly comprises:

a first motor connected to the gripper assembly, the first motor operable to adjust a length of the gripper arm to move the gripper in the vertical direction; and a second motor connected to the gripper assembly, the second motor operable to move the gripper in the horizontal direction.

4. The well rescue device of claim 3, wherein the seating assembly comprises an extendable seat rod and a seat attached to the extendable seat rod, the adjustment assembly further comprising:

a third motor connected to the seating assembly, the third motor operable to adjust a length of the extendable seat rod in the vertical direction; and a fourth motor connected to the seating assembly, the fourth motor operable to move the seat in the horizontal direction relative to the extendable seat rod.

* * * * *